United States Patent [19]

Duthie et al.

[11] Patent Number: 4,779,303

[45] Date of Patent: Oct. 25, 1988

[54] ROAD SWEEPING VEHICLES

[75] Inventors: Anthony J. Duthie, Horsham; Michael Sandford, Redhill, both of United Kingdom

[73] Assignee: Johnston Engineering Limited, Redhill, United Kingdom

[21] Appl. No.: 16,882

[22] Filed: Feb. 20, 1987

[30] Foreign Application Priority Data

Feb. 20, 1986 [GB] United Kingdom ..... 8604229

[51] Int. Cl.[4] ..... A47L 9/00; E01H 1/08

[52] U.S. Cl. ..... 15/326; 15/340.3; 55/276; 181/272

[58] Field of Search ..... 15/326, 340; 55/276; 181/268, 269, 272

[56] References Cited

U.S. PATENT DOCUMENTS 3,431,583 3/1969 Daneman ..... 15/340 X
3,886,624 6/1975 Landesman et al. ..... 15/340
4,598,791 7/1986 Bates ..... 181/272 X

FOREIGN PATENT DOCUMENTS 2951479 7/1981 Fed. Rep. of Germany ..... 15/326

*Primary Examiner*—Chris K. Moore
*Attorney, Agent, or Firm*—Young & Thompson

[57] ABSTRACT

A suction type road sweeping vehicle utilizes a suction fan for generating a vacuum within an air tight container mounted on the chassis. Suction conduits extend at one end into the container and are provided at the other end with nozzles. A sound attenuation system connected to an outlet duct of the fan comprises an expansion duct inside which is mounted a perforated panel connected to an attenuation duct, whose outlet exhausts to the atmosphere. Air expelled from the fan passes into the expansion duct, through the perforated panel which acts to raise the frequency of the sound of the air and through the attenuated duct, which has a noise absorbing lining which absorbs the sound as the air passes through the duct before being exhausted to atmosphere. Thus, the noise emitted by such road sweepers which, by the very nature of their construction and operation, are noisy vehicles, may be substantially reduced without hindering the flow of discharged air.

10 Claims, 2 Drawing Sheets

ROAD SWEEPING VEHICLES

The invention relates to suction type road sweeping vehicles and more particularly to such vehicles incorporating a sound attenuation system.

Many known road sweeping vehicles operate by means of an exhauster fan generating a vacuum within an air tight container, which is mounted on the chassis of the vehicle, and sucks the debris through suction conduits from the road. By the very nature of this system, the construction and operation of suction type road sweeping machines makes them noisy vehicles, due to the fact that most of them are equipped with two engines, one for propelling the vehicle, the other for driving the suction fan and sweeping machinary. It has however been established that the major sound producing elements of such machines are usually the flow of air into the debris pick up nozzle and the discharge of air from the exhauster fan outlet, which combined can account for up to 80% of the total sound emission from the road sweeper.

Since it is important that the flow of discharged air is not hindered, in order to maintain suction efficiency of the system, many road sweeping vehicles incorporate no form of sound attenuation system at all.

Other machines incorporate some form of duct or enclosure to attenuate the sound. But the sound of the air leaving the fan outlet is usually in a low frequency range of approximately 250–500 hz, and to properly attenuate sound of this frequency, would require a very long duct with a thick noise absorbing lining, the construction and incorporation of which is somewhat impractical.

Thus, the present invention provides a suction type road sweeping vehicle comprising a self propelled chassis, an air tight container mounted on the chassis and communicating with a fan for generating a vacuum within said container, at least one suction conduit extending at one end into the container and being provided at the other end with a suction pick-up nozzle, and a sound attentuation system connected to an outlet of the fan, comprising an expansion duct inside which is mounted a perforated panel having holes of a diameter suitable to shift a dominant noise frequency to a predetermined higher range, which is connected to an attenuation duct, whose outlet exhausts to atmosphere, the arrangement being such that, in use, expelled air from the fan passes into the expansion duct, through the perforated panel and through the attenuation duct before being finally exhausted into the atmosphere.

The suction type road sweeping vehicle is preferably provided with brush means mounted on the vehicle forwardly adjacent the suction conduit and comprising a rotatable brush movably connected to the vehicle chassis for movement between an operating position and a stowed position.

The suction type road sweeping vehicle may also comprise a suction conduit and pick up nozzle on either side of the vehicle, means for separately closing off one end of each conduit to prevent refuse from passing through the conduit when it is closed, and brush means on either side of the vehicle operable such that one brush rotates in the operating position whilst the other is in the stowed position.

The perforated panel preferably has holes of a diameter suitable to shift a dominant noise frequency to a predetermined higher range.

The perforated panel may also be a mesh comprising holes of a diameter in the range 4 to 5 mm with a hole density of greater than 20,000 holes/$m^2$ and preferably comprises holes of diameter 4.75 mm.

The attenuation duct is preferably lined with an absorptive material, or a noise attenuating material matched to suppress the dominant noise frequencies and is between 20 mm and 50 mm thick, preferably being 25 mm thick.

The invention further comprises a method of attenuating the sound emission from a suction type road sweeping vehicle comprising the steps of passing the air from an exhauster fan into an expansion duct and effecting a shift of the frequency of the sound of the air to a higher frequency range by means of a perforated panel and attenuating the high frequency sound by means of a duct lined with an absorbtive layer.

A preferred embodiment of the invention will now be described in detail with reference to the accompanying drawing in which.

Figure 1:
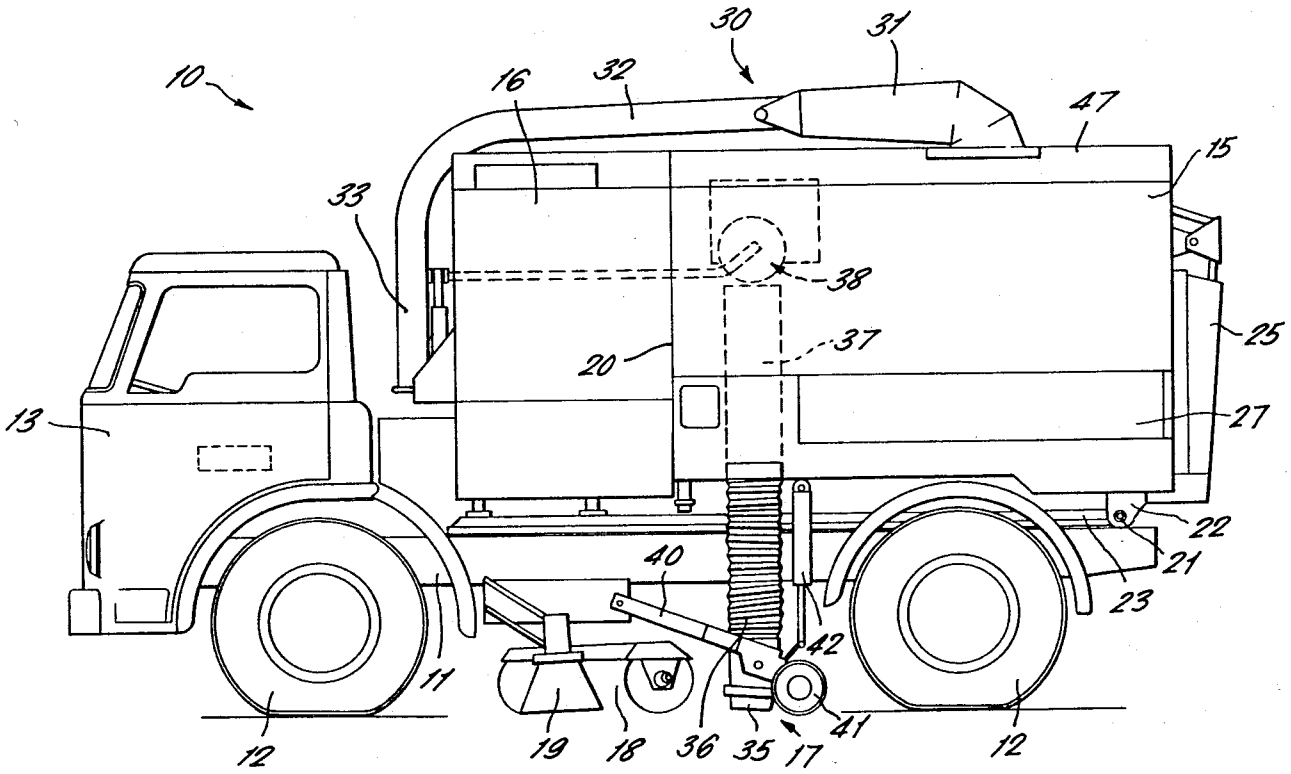
FIG. 1 is a schematic side view of a typical road sweeping vehicle.

The basic road sweeping vehicle in which the present invention is incorporated is as described in GB No, 1592775 and shown in FIG. 1.

A dual sweep suction road sweeping vehicle 10 comprises a self propelled chassis 11 including road wheels 12 and drivers cab 13, on which are mounted a tipping body 15, a fan housing 16, suction equipment 17, a wide sweep brush 18 and a pair of channel brushes 19, one located on either side of the vehicle.

The tipping body 15 is a steel monocoque assembly which is pivotable about a horizontal axis 21 adjacent its rear end. The body is mounted on a subframe of steel members 23 to which the body is pivotally attached by means of flanges 22 depending from the body. The subframe is rigidly mounted on the chassis 11, which may be any suitable type of vehicle chassis, provided with driving controls in the cab 13. The interior of the tipping body provides an airtight container for dust, etc., swept up by the vehicle and is closed off by a rear door 25. The rear door is pivoted about its upper edge and is operable by a ram (not shown) in known manner to permit egress of material contained in the body when it is tipped. A further ram (not shown) connected between the front part of the tipping body 15 and the subframe 23 is operable to tip the body.

Protruding from the top of the tipping body 15 is a wandering hose 30 comprising a first section 31 which communicates with the interior of body 15 and is pivotable about a vertical axis. Hingedly connected to the first section 31 is a second hose section 32 which is L-shaped so that a nozzle 33 of the wandering hose may be brought adjacent to the ground by pivotal and hinging movement of the wandering hose.

The suction equipment 17 comprises, on each side of the vehicle, a nozzle 35 connected by a conduit 36 to an inlet duct 37 into the body 15, the connection being arranged such that the body may be tipped. The conduits are provided with shutting means 38 for closing off one end thereof to prevent refuse from entering the container via that conduit. This enables the vehicle to be used to sweep either side of the road regardless of the direction of travel of the vehicle, using one set of suction equipment only. Wheels 41 are provided on a draw bar 40 on to which the nozzle 35 is pivotably mounted, the purpose of which is to control the height of the nozzle above the road surface. The nozzle and wheel assembly may be lifted clear of the road by a ram 42 when the conduit on that side of the vehicle is not in use.

The channel brushes 19 are situated in front of the nozzles 35 and are movably mounted to the chassis 11 by means of a bracket and pivotal link system (not shown) to allow floating of movement the brushes 19 relative to the ground.

The wide sweep brushes 19 are suspended from the chassis 11 and mounted for rotation and have means such that they may be raised off the ground when not in use.

The two sets of brushes 18 and 19 are driven by separate hydraulic motors (not shown).

Figure 2:
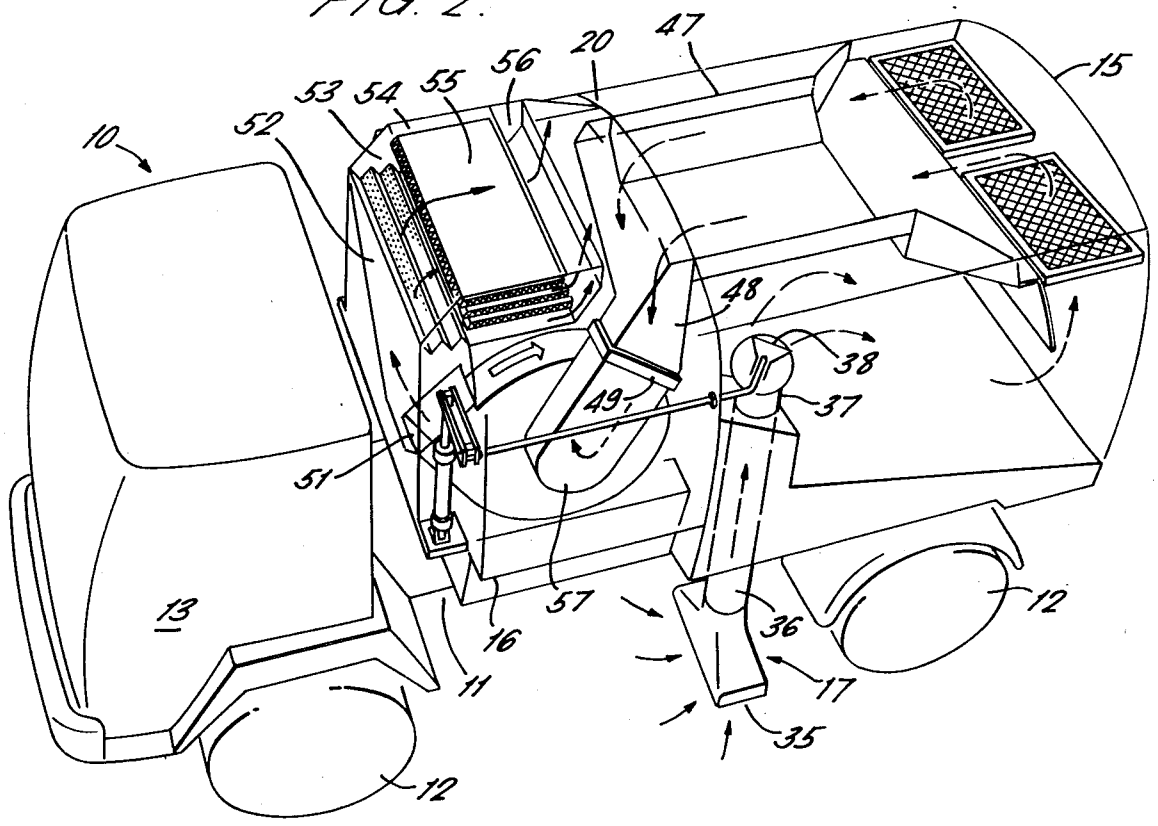
FIG. 2 is a schematic perspective view of a road sweeping vehicle incorporating a sound attenuation system, but with certain parts ommited.

The interior of the body 15 is partitioned off to form a duct 47, which is flared at its end adjacent to rear of the body and the rearmost portion is formed by a mesh grill 50 which extends across the full width of the body at the position shown in FIG. 2. Duct 47 is connected by another duct 48 to a flanged connector 49 which is connected to the inlet side of a suction fan, when the body is in its lowered position as shown.

Extending upwardly into the body at either side and adjacent its front end are inlet ducts 37 which are connected to suction conduits 36.

The engine housing or canopy 16 extends from the front of the tipping body 15 to which it is rigidly connected and from which it is divided by partition 20. The engine housing 16 encloses an engine and suction fan 57 which are mounted on the subframe 23 and apply suction to the interior of the sweeping body when the vehicle is working. The ancillary hydraulic equipment, fuel tanks, etc., for the sweeping equipment are also mounted on the subframe within the housing 16.

Referring now to FIG. 2, which shows a typical suction type road sweeping vehicle as previously described incorporating a sound attenuation system, it will be appreciated that certain parts have been omitted for clarity but are shown in FIG. 1.

The outlet duct 51 to the suction fan 57 is connected to one end of an expansion chamber 52, which is rectangular in cross section and extends across the front end of the engine housing 16. The other end of the expansion chamber 52 connects to an attenuation duct 54, which is also rectangular in cross section. Where the expansion duct 52 meets the attenuation duct 54 there is fitted a perforated panel 53 corrugated to increase its area. This perforated panel acts to raise the frequency of the sound of the air. At the other end of the attenuation duct 54 is an angled portion 56 to expel exhausted air upwardly away from the vehicle. The attenuation duct 54 is provided with splitter panels 55 lined with a noise absorbing lining 55 which absorbs the sound as the air passes through the narrow channels between the splitters within the duct, before being finally exhausted to the atmosphere.

The mesh panel, splitter spacing and lining are matched to ensure that effective noise attenuation occurs. The perforated panel area must be such as to suit the air flow through it, not hindering it, which would reduce the effectiveness of the sweeper and to ensure that the frequency of sound is shifted from a low range, typically 250/500 Hz, to a higher one around 1000 Hz which can be attenuated by relatively short length ducts lined with a less bulky thinner material, which may be accommodated within the physical dimension constraints of the equipment.

A suitable noise absorbent lining is preferably a purpose skinned foam material, for example open cell foam clad with MYLAR, which provides a diaphragm permitting the absorption of noise yet allowing the duct to be cleaned without affecting the foam.

In one particular example it was found that using a panel of steel mesh comprising holes of 4.75 mm diameter and with a hole density of 23810 holes/$m^2$, a mesh area of 0.5 $m^2$ and thickness of 2 mm and lining the attenuation duct with the purpose skinned foam, achieved a reduction in the fan outlet sound of approximately 10 dBA.

What is claimed is:

1. A suction type road sweeping vehicle comprising a self propelled chassis, an air tight container mounted on the chassis, a fan communicating with said container for generating a vacuum within the container, at least one suction conduit extending at one end into the container, and at least one suction pick up nozzle being provided at another end of said suction conduit, wherein a sound attenuation system is connected to an outlet of the fan, said attenuation system comprising an expansion duct, a perforated panel mounted inside said expansion duct and having holes of a diameter suitable to shift a dominant noise frequency to a predetermined higher range, and an attenuation duct connected to said expansion duct, said attenuation duct having an outlet which exhausts to atmosphere, the arrangement being such that, in use, expelled air from the fan passes into the expansion duct, through the perforated panel and through the attenuation duct being finally exhausted into the atmosphere.

2. A suction type road sweeping vehicle as claimed in claim 1 having brush means mounted on the vehicle forwardly adjacent the suction conduit and comprising a rotatable brush movably connected to the vehicle chassis for movement between an operating position and a stowed position.

3. A suction type road sweeping vehicle as claimed in claim 2 comprising a suction conduit and pick up nozzle on either side of the vehicle, means for separately closing off one end of each conduit to prevent refuse from passing through the conduit when it is closed and brush means on either side of the vehicle operable such the one brush is rotating in the operating position whilst the other is in the stowed position.

4. A suction type road sweeping vehicle as claimed in claim 1 in which the perforated panel is a mesh comprising holes of a diameter in the range of 4 to 5 mm with a hole density of greater than 20,000 holes/$m^2$.

5. A suction type road sweeping vehicle as claimed in claim 4 in which the perforated panel is a mesh comprising holes of diameter 4.75 mm with a hole density of 23,810 holes/$m^2$.

6. A suction type road sweeping vehicle as claimed in claim 1 in which the attenuation duct is lined with an absorptive material.

7. A suction type road sweeping vehicle as claimed in claim 6 in which the attenuation duct is lined with a noise attenuating material matched to suppress the dominant noise frequencies.

8. A suction type road sweeping vehicle as claimed in claim 7 in which the duct lining is between 20 mm and 50 mm thick.

9. A suction type road sweeping vehicle as claimed in claim 8 in which the duct lining is 25 mm thick.

10. A method of attenuating the sound emission from a suction type road sweeping vehicle as claimed in claim 1, comprising the steps of passing the air from an exhauster fan into an expansion duct, effecting a shift in the frequency of the sound of the air to a higher frequency range by means of a perforated panel and attenuating the high frequency sound by means of a duct lined with an absorptive layer.

* * * * *